US007871158B2

(12) United States Patent
Kaneko

(10) Patent No.: US 7,871,158 B2
(45) Date of Patent: Jan. 18, 2011

(54) IMAGE FORMING APPARATUS AND METHOD FOR CONTROLLING THE IMAGE FORMING APPARATUS

(75) Inventor: Tetsuya Kaneko, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 603 days.

(21) Appl. No.: 11/953,565

(22) Filed: Dec. 10, 2007

(65) Prior Publication Data

US 2008/0136849 A1 Jun. 12, 2008

(30) Foreign Application Priority Data

Dec. 12, 2006 (JP) ..... 2006-334354

(51) Int. Cl.
*B41J 2/175* (2006.01)

(52) U.S. Cl. ..... 347/86; 347/7; 347/85

(58) Field of Classification Search ..... 347/5, 347/7, 9, 19, 85, 86
See application file for complete search history.

(56) References Cited

U.S. PATENT DOCUMENTS 6,695,443 B2 2/2004 Arita et al.
6,712,460 B2 * 3/2004 Ohashi et al. ..... 347/86
7,540,598 B2 * 6/2009 Hori et al. ..... 347/86

FOREIGN PATENT DOCUMENTS

| | | |
|---|---|---|
| JP | 11-192720 | 7/1999 |
| JP | 2003-334979 | 11/2003 |
| JP | 2005-59274 | 3/2005 |
| JP | 2005-59490 | 3/2005 |
| JP | 2005-59491 | 3/2005 |
| JP | 2005-81596 | 3/2005 |
| JP | 2005-144939 | 6/2005 |

* cited by examiner

*Primary Examiner*—Lam S Nguyen
(74) *Attorney, Agent, or Firm*—Cooper & Dunham LLP

(57) ABSTRACT

An image forming apparatus includes a recording head, a main tank, a sub tank, a negative pressure state indicator, a position detector, and a sub tank position indicator. The recording head discharges recording liquid. The main tank supplies the recording liquid. The sub tank is supplied with the recording liquid from the main tank and supplies the recording liquid to the recording head. The negative pressure state indicator is displaced according to a negative pressure state of the sub tank to indicate the negative pressure state of the sub tank. The position detector detects the displacement of the negative pressure state indicator as position information. The sub tank position indicator is detected by the position detector and indicates a position of the sub tank without being displaced according to the negative pressure state of the sub tank.

11 Claims, 13 Drawing Sheets

IMAGE FORMING APPARATUS AND METHOD FOR CONTROLLING THE IMAGE FORMING APPARATUS

BACKGROUND

1. Technical Field

The present specification relates to an image forming apparatus and a method for controlling the image forming apparatus, and more particularly, to an image forming apparatus and a method for controlling the image forming apparatus for detecting a shift in position of a recording head in a main scanning direction.

2. Discussion of the Background

An ink-jet recording apparatus, serving as an image forming apparatus, such as a copying machine, a facsimile machine, a printer, or a multifunction printer having two or more of copying, printing, scanning, and facsimile functions, forms an image on a medium (e.g., a sheet) by discharging liquid.

The ink-jet recording apparatus includes an ink cartridge and a sub tank. The ink cartridge is provided in a device body, and mainly stores liquid (e.g., an ink) to be supplied to the sub tank. The sub tank is provided on a recording head, and temporarily stores ink supplied from the ink cartridge. The ink stored in the sub tank is supplied to the recording head. The recording head is carried by a carriage and discharges ink onto a conveyed sheet. The ink is adhered to the sheet to form an image on the sheet.

In order to maintain high image quality, stable ink discharge is needed. Thus, proper control of negative pressure inside the sub tank is important. In one example of a related art ink-jet recording apparatus, for example, an air intake valve opens to discharge a predetermined amount of air remaining in the sub tank, and the air intake valve closes to discharge a predetermined amount of ink. Therefore, a negative pressure generation mechanism in the sub tank functions to generate a predetermined negative pressure inside the sub tank.

The sub tank includes a film member forming an ink container. On the outer surface of the film member there is provided a negative pressure lever. The negative pressure lever may be displaced according to deformation of the film member.

In another example of a related art ink-jet recording apparatus, since negative pressure in the sub tank increases as an amount of ink in the sub tank decreases due to discharging of ink drops, when a predetermined amount of ink is consumed, ink is filled to prevent an excessive increase of negative pressure.

In order to provide a compact ink-jet recording apparatus, the carriage carrying the sub tank and the recording head is requested to be made more compact. Therefore, a shift amount of the negative pressure lever mounted on the carriage needs to be small, and thus, even a slight shift in a position of the negative pressure lever affects negative pressure in the sub tank.

Ink discharge depends on the precision with which the position of the negative pressure lever is detected. If the position of the negative pressure lever is not precisely detected, then when an ink supply operation is performed based on incorrect information about the position of the negative pressure lever ink might leak from the recording head because excessive ink is supplied to the sub tank, or, conversely, a faulty image may be formed due to insufficient ink.

SUMMARY

This patent specification describes an image forming apparatus, one example of which includes a recording head, a main tank, a sub tank, a negative pressure state indicator, a position detector, and a sub tank position indicator. The recording head is configured to discharge recording liquid. The main tank is configured to supply the recording liquid. The sub tank is supplied with the recording liquid from the main tank and configured to supply the recording liquid to the recording head. The negative pressure state indicator is displaced according to a negative pressure state of the sub tank to indicate the negative pressure state of the sub tank. The position detector is configured to detect the displacement of the negative pressure state indicator as position information. The sub tank position indicator is detected by the position detector and configured to indicate a position of the sub tank without being displaced according to the negative pressure state of the sub tank.

This patent specification also describes a method for controlling an image forming apparatus. One example of such a method for controlling an image forming apparatus includes detecting a position of a sub tank position indicator with a position detector, detecting a position of a negative pressure state indicator, correcting position information of the negative pressure state indicator based on information about the detected position of the sub tank position indicator, detecting a negative pressure state of a sub tank based on the corrected position information of the negative pressure state indicator, and supplying recording liquid from a main tank to the sub tank while or until the position detector detects the negative pressure state indicator.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
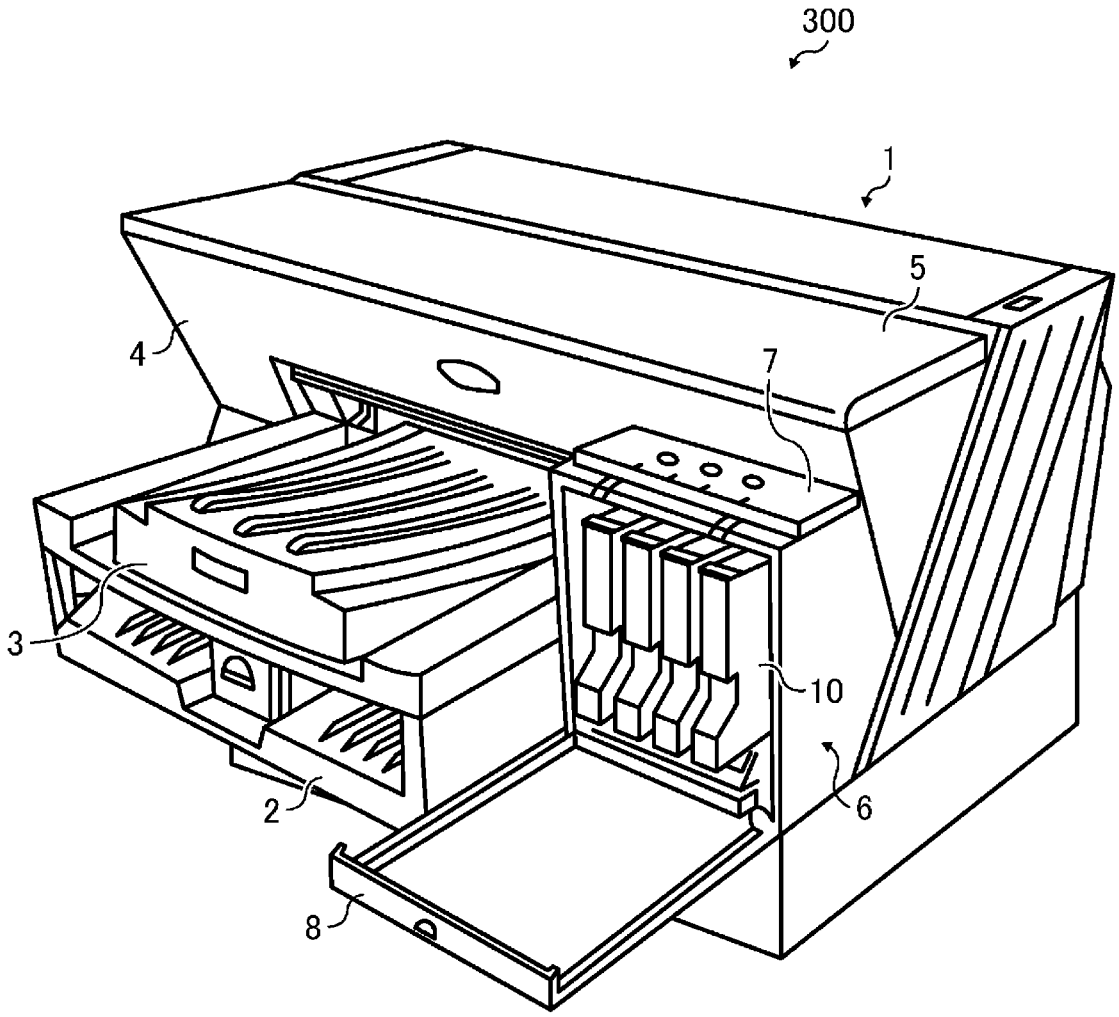
FIG. 1 is a perspective view of an ink-jet recording apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an ink-jet recording apparatus 300 according to an exemplary embodiment is described.

FIG. 1 is a perspective view of the ink-jet recording apparatus 300. The ink-jet recording apparatus 300 includes a body 1, a paper tray 2, and an output tray 3. The body 1 includes a front face 4, a top cover 5, a cartridge holder 6, a control panel 7, and ink cartridges 10. The cartridge holder 6 includes a front cover 8.

The paper tray 2 is attached to the body 1, and stores a recording medium (e.g., sheet), which may be, but is not limited to, paper. The output tray 3 is also attached to the body 1 and receives the sheet bearing an image. The front cover 8 may open and close to attach and detach the ink cartridges 10. The ink cartridges 10, serving as main tanks, store liquid (e.g. ink). The cartridge holder 6 is provided lower than the top cover 5 and protrudes forward from one end of the front face 4 of the body 1. The control panel 7 is provided on a top surface of the cartridge holder 6, and includes an operation key and a display, not shown.

Figure 2:
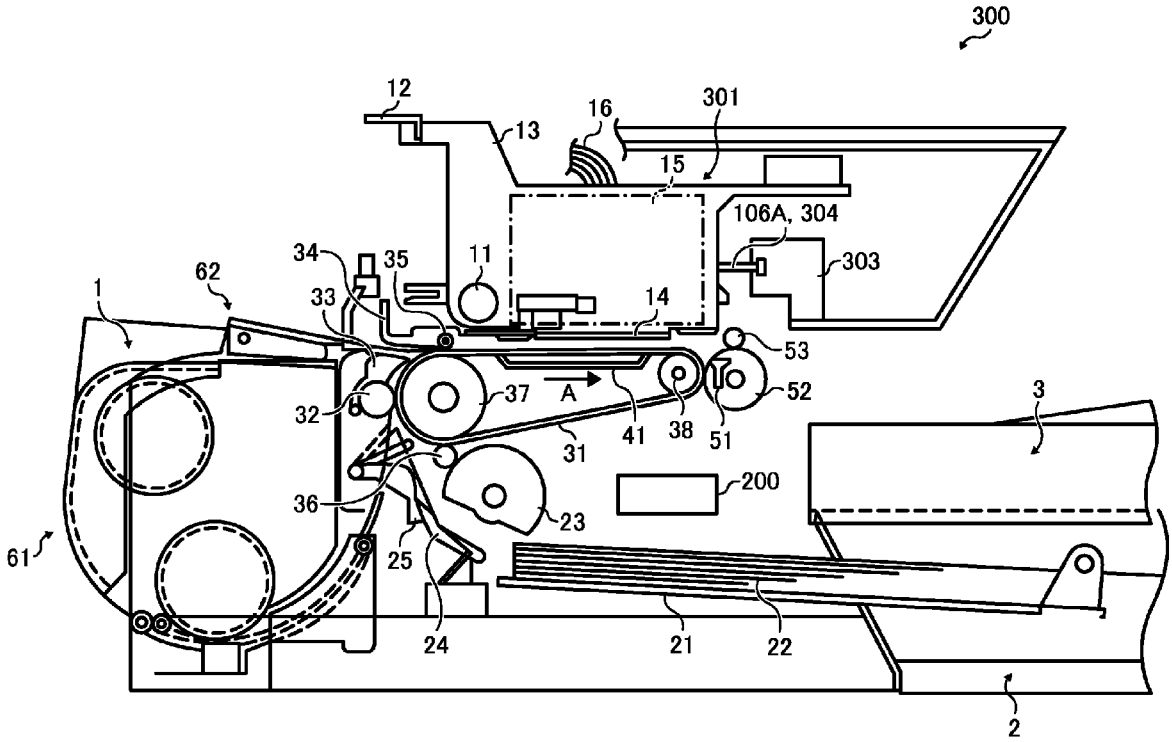
FIG. 2 is a sectional view of the ink-jet recording apparatus shown in FIG. 1.
Figure 3:
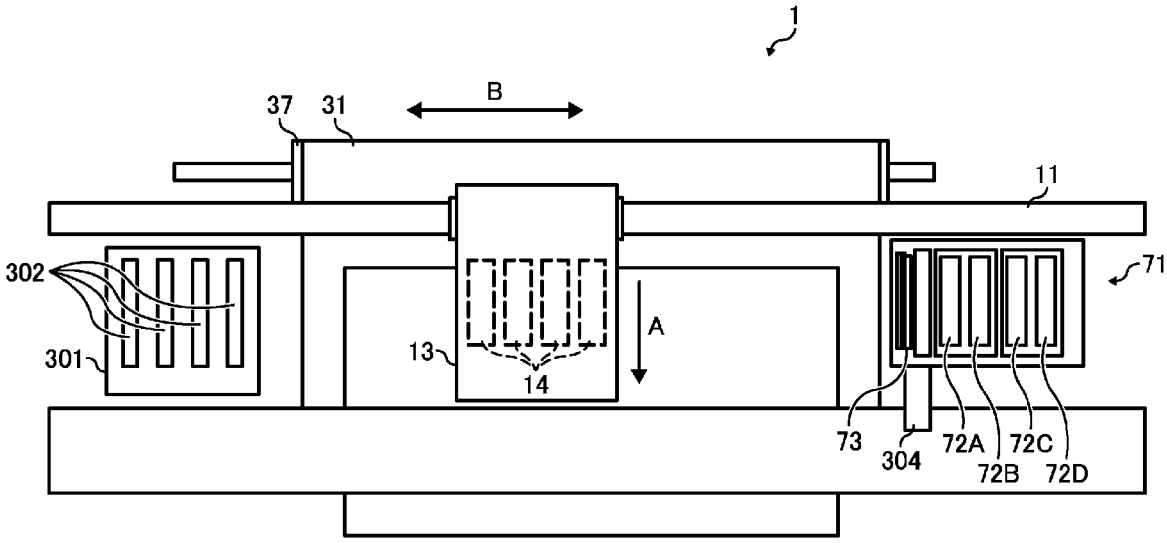
FIG. 3 is a top plan view of the ink-jet recording apparatus shown in FIG. 2.

Referring to FIGS. 2 and 3, a description is now given of further details of the ink-jet recording apparatus 300. FIG. 2 is a sectional view of the ink-jet recording apparatus 300. The body 1 further includes a guide rod 11, a stay 12, a carriage 13, recording heads 14, an ink supply device 301, ink supply tubes 16, a feed roller 23, a separation pad 24, a guide 25, a conveyance belt 31, a counter roller 32, a conveyance guide 33, a pressing member 34, a pressing roller 35, a charging roller 36, a conveyance roller 37, a tension roller 38, a guide member 41, a separation nail 51, a discharging roller 52, a counter roller 53, a duplex unit 61, a bypass tray 62, a negative pressure lever position sensor 303, and a controller 200. The paper tray 2 includes a stacking member 21 (e.g. platen). The ink supply device 301 includes sub tanks 15. The sub tanks 15 include detection edges 106A and 304.

FIG. 3 is a plane view of a main part of the ink-jet recording apparatus 300. The body 1 further includes a sub-system 71 and a blank discharge receiver 301. The sub-system 71 includes capping members 72A, 72B, 72C, and 72D, and a wiper blade 73. The blank discharge receiver 301 includes slits 302.

As illustrated in FIG. 2, the carriage 13 is slidably held by the guide rod 11 and the stay 12, and is driven by a main scanning motor, not shown, to move in a main scanning direction B (depicted in FIG. 3). The guide rod 11 is laid across right and left side plates, not shown, and guides the carriage 13. The recording heads 14 include four ink-jet heads for discharging ink drops in yellow, cyan, magenta, and black colors. The recording heads 14 also include a plurality of ink outlets, not shown. The ink outlets are provided in a direction perpendicular to the main scanning direction B, and discharge ink in a downward direction.

The ink-jet heads forming the recording heads 14 may include an actuator for generating energy for discharging ink such as a piezoelectric actuator including a piezoelectric element, a thermal actuator using a phase change due to film boiling of liquid by using electrothermal conversion elements such as a heat generating resistance body, a shape-memory-alloy actuator using a metal phase change due to a temperature change, and an electrostatic actuator using electrostatic force. The ink-jet heads according to this non-limiting exemplary embodiment include a piezoelectric actuator including a piezoelectric element. The recording heads 14 may include a single ink-jet head including a plurality of nozzles for discharging respective color liquid drops.

The sub tanks 15 are mounted on the carriage 13 and serve as liquid containers for supplying the respective colors of ink to the recording heads 14. The ink is supplied from the ink cartridges 10 (depicted in FIG. 1), serving as main tanks, to replenish the sub tanks 15 through the ink supply tubes 16. The ink cartridges 10 store yellow, cyan, magenta, and black color ink, respectively. The ink cartridge 10 for storing the black color ink has a greater capacity for storing ink than the ink cartridges 10 for storing the other colors of ink.

The feed roller 23 and the separation pad 24 oppose each other, and feed sheets 22 stacked on the stacking member 21 of the paper tray 2. The feed roller 23 and the separation pad 24 feed the sheets 22 one by one from the stacking member 21. The separation pad 24 has a half-moon-like shape and includes a material with a high friction coefficient. The separation pad 24 is pressed toward the feed roller 23.

The conveyance belt 31, the counter roller 32, the conveyance guide 33, the pressing member 34, the pressing roller 35, the charging roller 36, the conveyance roller 37, and the tension roller 38 form a conveyer for conveying the sheet 22 fed from the paper tray 2 under the recording heads 24. The conveyance belt 31 electrostatically attracts the sheet 22 and conveys the sheet 22. The sheet 22 fed from the paper tray 2 and guided by the guide 25 is fed to a nip formed between the counter roller 32 and the conveyance belt 31. The sheet 22 is fed substantially in a vertical direction and rotated at an angle of about 90 degrees by the conveyance guide 33 so that the sheet 22 is attracted and carried by the conveyance belt 31. The pressing member 34 presses the pressing roller 35 against the conveyance belt 31. The charging roller 36 charges a surface of the conveyance belt 31.

The seamless conveyance belt 31 is looped over the conveyance roller 37 and the tension roller 38 so that the conveyance belt 31 rotates in a conveyance direction A. The charging roller 36 contacts the surface of the conveyance belt 31, and is driven by the rotating conveyance belt 31. A pressure of about 2.5 N is respectively applied at both ends of an axis of the charging roller 36.

The guide member 41 is provided on a back side of the conveyance belt 31 corresponding to a printing area of the recording heads 14. A top surface of the guide member 41 protrudes from a tangential line of two rollers (e.g., the conveyance roller 37 and the tension roller 38) for supporting the conveyance belt 31 toward the recording heads 14. Accordingly, the printing area is pressed upward by the top surface of the guide member 41 so that the conveyance belt 31 may be kept flat.

The guide member 41 includes a plurality of grooves, not shown, formed on a surface contacting the back side of the conveyance belt 31 in the main scanning direction B (depicted in FIG. 3), that is, a direction perpendicular to the conveyance direction A. Thus, a contact area between the guide member 41 and the conveyance belt 31 decreases so that the conveyance belt 31 may smoothly move along the surface of the guide member 41.

In order to discharge the sheet 22 bearing an image formed by the recording heads 14, the separation nail 51, the discharging roller 52, and the counter roller 53 are provided. The separation nail 51 separates the sheet 22 from the conveyance belt 31. The output tray 3 is provided below the discharging roller 52. There is a certain distance in a vertical direction from a nip formed between the discharging roller 52 and the counter roller 53 to the output tray 3 so that the output tray 3 may receive a great number of sheets 22.

The duplex unit 61 is attached to a back portion of the body 1, and attachable to and detachable from the body 1. The duplex unit 61 receives the sheet 22 fed back by the conveyance belt 31 rotating in a direction opposite to the conveyance direction A, reverses the sheet 22, and feeds the sheet 22 to the nip formed between the counter roller 32 and the conveyance belt 31. The bypass tray 62 is provided on a top surface of the duplex unit 61.

As illustrated in FIG. 3, the sub-system 71, serving as a maintenance mechanism, is provided in a non-printing area on one end of the body 1 in the main scanning direction B and maintains the nozzles of the recording heads 14 in good condition. The capping members 72A to 72D cap nozzle surfaces of the recording heads 14. The wiper blade 73 wipes the nozzle surfaces of the recording heads 14. According to this non-limiting exemplary embodiment, the closest capping member 72A to a recording area functions as a suction and moisturization cap connected to a suction pump, not shown, while the other capping members 72B to 72D function as moisturization caps.

The blank discharge receiver 301 is provided in another non-printing area on another end of the body 1 in the main scanning direction B, and receives ink blank-discharged to prevent faulty discharge due to the drying up of ink inside a nozzle from lack of use. The slits 302 are provided for the respective nozzles of the recording heads 14.

As illustrated in FIG. 2, in the ink-jet recording apparatus 300 having the above-described structure, sheets 22 are fed one by one from the paper tray 2. The sheet 22 is upwardly fed substantially in the vertical direction, guided by the guide 25, and nipped and conveyed between the conveyance belt 31 and the counter roller 32. When the conveyance guide 33 guides a leading edge of the sheet 22 to be pressed against the conveyance belt 31 by the pressing roller 35, the sheet 22 turns around at an angle of about 90 degrees.

When a control circuit, not shown, causes a high-voltage power supply, not shown, to alternately apply a positive voltage and a negative voltage (e.g., alternating voltages) to the charging roller 36, the surface of the conveyance belt 31 has an alternating charged voltage pattern in which the positive and negative voltages of predetermined width are alternately applied in a belt-like form in a sub-scanning direction (e.g., a direction of rotation of the conveyance belt 31, the conveyance direction A). When the sheet 22 is conveyed to the conveyance belt 31 charged with alternating positive and negative voltages, the sheet 22 is electrostatically attracted to the conveyance belt 31 and conveyed in the sub-scanning direction with the rotation of the conveyance belt 31.

While the carriage 13 moves to drive the recording heads 14 based on an image signal, the recording heads 14 discharge ink drops on the stopped sheet 22 to record one line. After the sheet 22 is conveyed a predetermined distance, recording of a next line is performed. Upon receipt of a record end signal or a signal indicating that a trailing edge of the sheet 22 reaches the recording area, a recording operation is finished and the sheet 22 discharged to the output tray 3.

As illustrated in FIG. 3, while waiting for printing (e.g., recording), the carriage 13 moves to the sub-system 71, and the recording heads 14 are capped by the capping members 72A to 72D of the sub-system 71. Thus, the nozzles of the recording heads 14 may be maintained to be damp or wet, thereby preventing a failure of discharge due to dried ink. Before or during recording, the sub-system 71 recovers discharging ink not used for recording to maintain stable discharge of the recording heads 14. When recovery is performed, one of the recording heads 14, from which ink is suctioned, moves to a position of the capping member 72A serving as a suction cap, and is capped by the capping member 72A.

As illustrated in FIG. 2, the negative pressure lever position sensor 303 detects the detection edge 106A. The controller 200 controls operations of the ink-jet recording apparatus 300.

Figure 4:
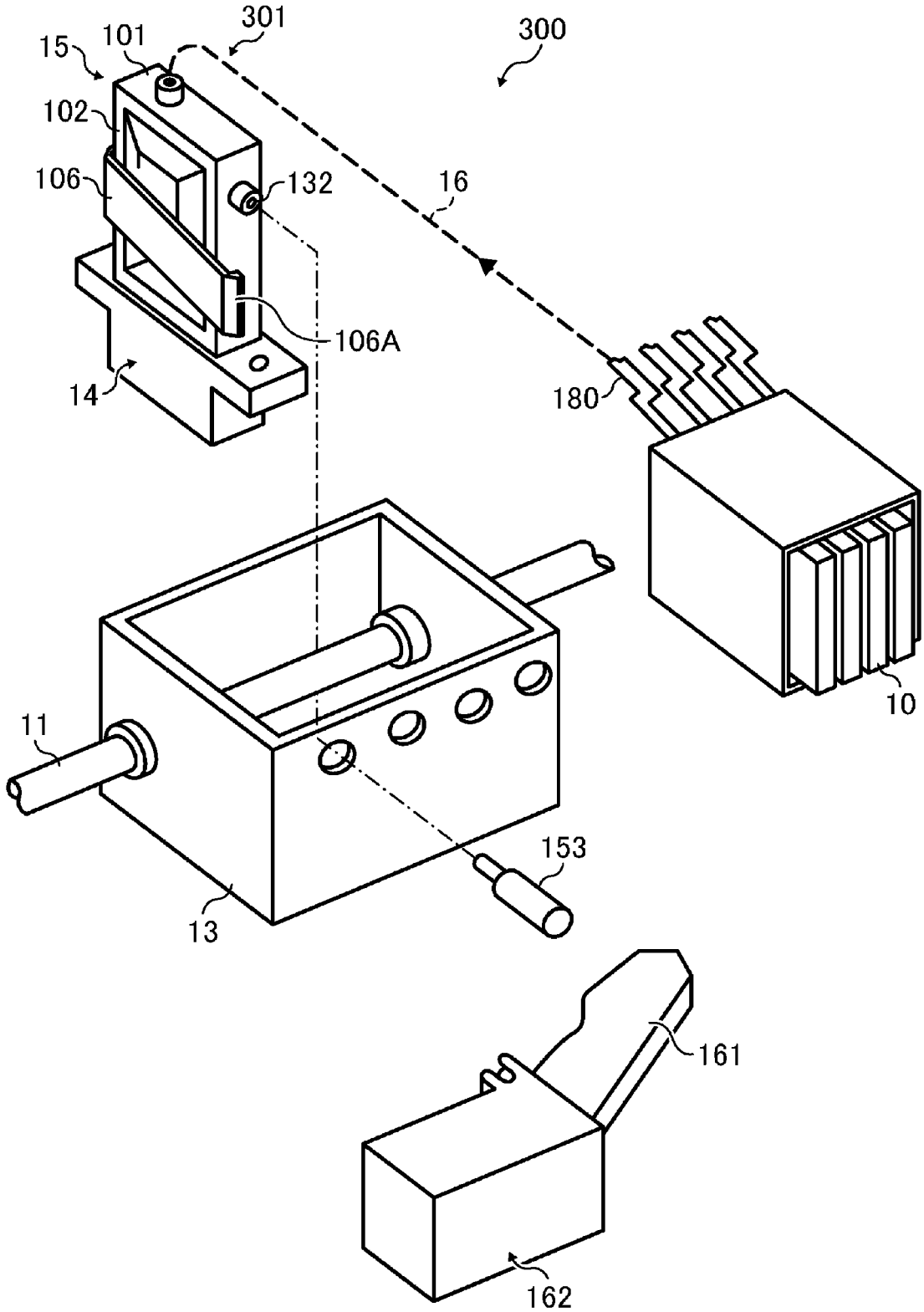
FIG. 4 is an exploded perspective view of an ink supply device included in the ink-jet recording apparatus shown in FIG. 3.
Figure 7:
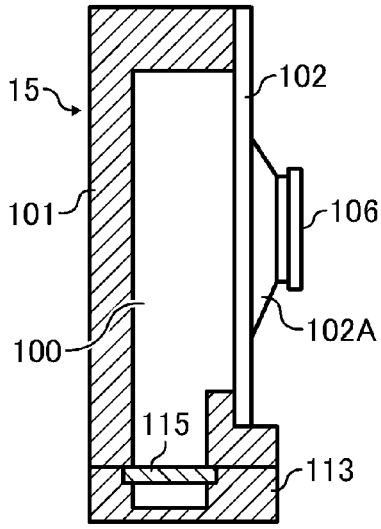
FIG. 7 is a sectional front view of the sub tank shown in FIG. 6.

Referring to FIGS. 4 and 7, a description is now given of the ink supply device 301.

Figure 5:
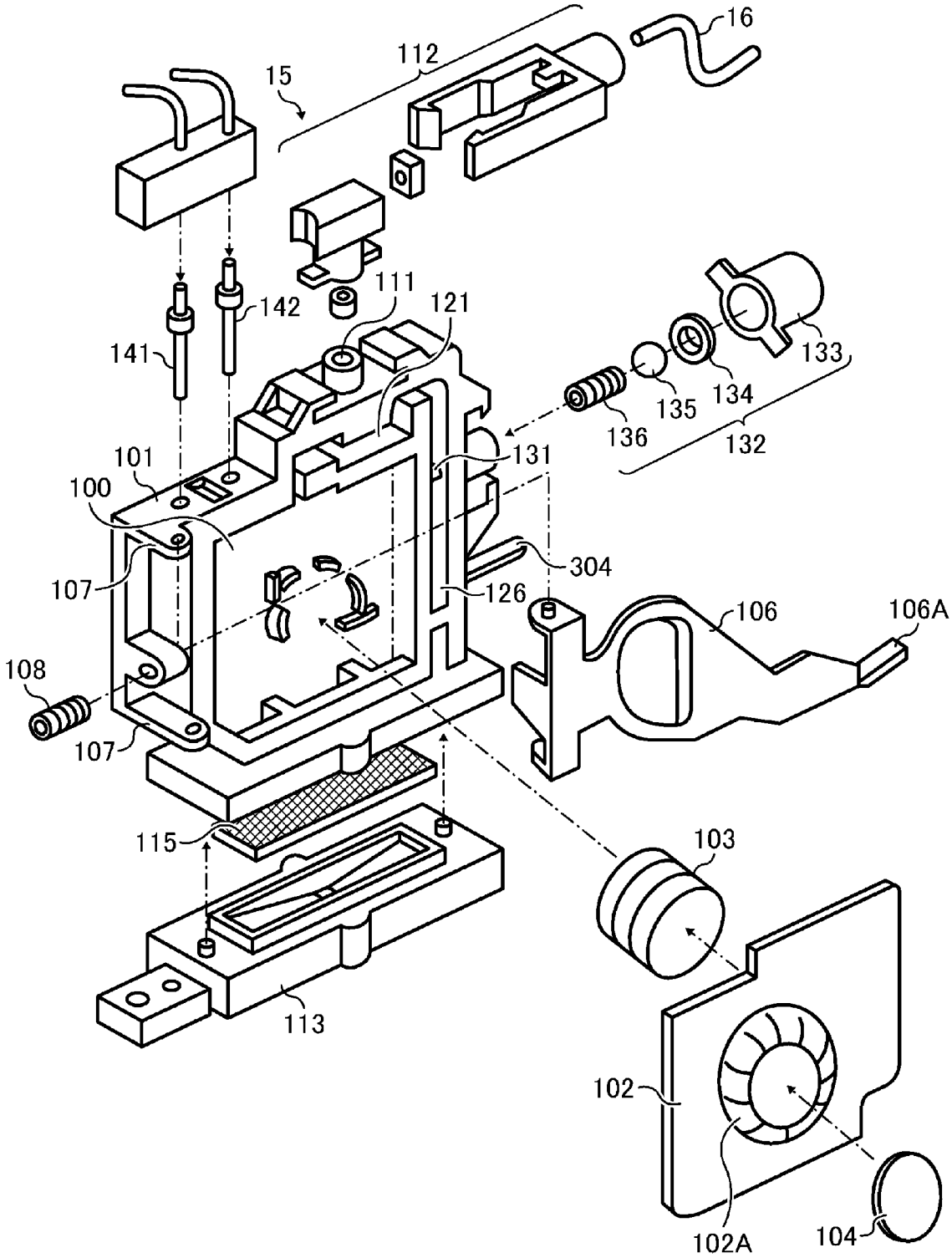
FIG. 5 is an exploded perspective view of a sub tank included in the ink supply device shown in FIG. 4.
Figure 6:
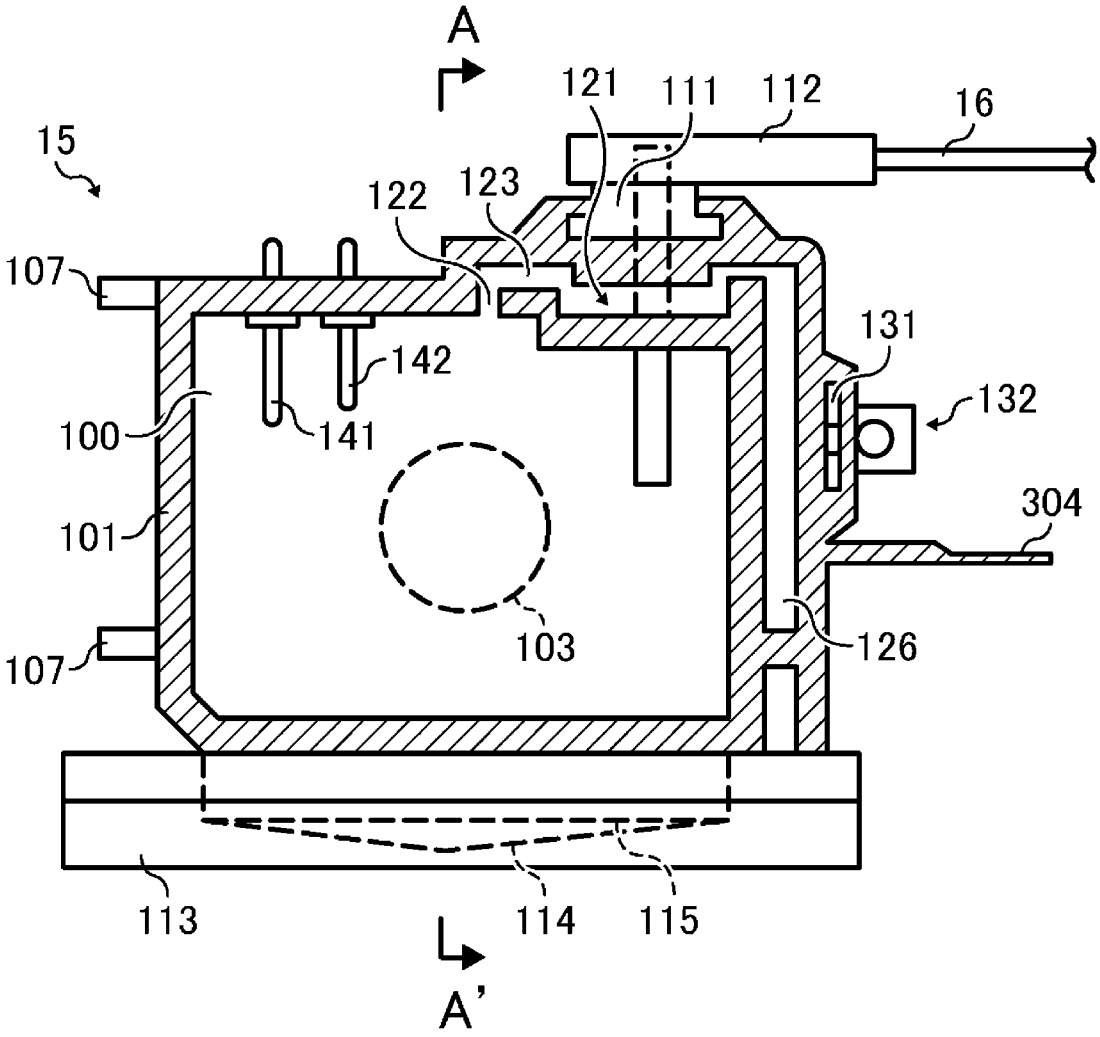
FIG. 6 is a sectional side view of the sub tank shown in FIG. 5.

FIG. 4 is an exploded perspective view of the ink supply device 301. FIG. 5 is an exploded perspective view of the sub tank 15. FIG. 6 is a side view of the sub tank 15. FIG. 7 is a sectional view of the sub tank 15 along a line A-A' shown in FIG. 6.

As illustrated in FIG. 4, the ink-jet recording apparatus 300 further includes a liquid sending mechanism 180. The ink supply device 301 includes the sub tanks 15 and the ink cartridges 10. The sub tank 15 includes a case body 101, a film member 102, a negative pressure lever 106, an air intake valve mechanism 132, an air intake pin 153, and a drive unit 162. The negative pressure lever 106 includes the detection edge 106A. The drive unit 162 includes a lever 161.

As illustrated in FIG. 5, the sub tank 15 further includes a spring 103, a reinforcement member 104, support members 107, a spring 108, an ink introduction channel 111, a connector 112, a connection member 113, a filter 115, detection electrodes 141 and 142. The case body 101 includes an ink container 100, an air intake port 131, and an air flow channel 121. The film member 102 includes an outwardly convex bulge 102A. The air intake valve mechanism 132 includes a holder 133, a valve seat 134, a ball 135, and a spring 136. The air flow channel 121 includes an accumulation portion 126.

As illustrated in FIG. 6, the air flow channel 121 further includes an inlet channel portion 122 and a channel portion 123. The connection member 113 includes an ink supply channel 114.

As illustrated in FIG. 4, the negative pressure lever position sensor 303 (depicted in FIG. 2) detects the detection edge 106A of the negative pressure lever 106 to detect displacement of the negative pressure lever 106. The negative pressure lever 106, serving as a negative pressure indicator, indicates a state of negative pressure of the sub tank 15. The negative pressure lever position sensor 303 may be a photointerrupter for detection of presence or absence of the negative pressure lever 106. By using a system, not shown, for detecting position information of the carriage 13, that is, a combination of an encoder, the photointerrupter, and the like, the negative pressure lever position sensor 303 may detect a position of the negative pressure lever 106 based on the position information of the carriage 13 when the detection edge 106A of the negative pressure lever 106 is detected by the negative pressure lever position sensor 303.

The liquid sending mechanism 180 sends ink from the ink cartridge 10 to the ink supply device 301. The ink supply device 301 includes the sub tank 15 (e.g., liquid container) mounted on the carriage 13 to supply ink to the recording head 14, and the ink cartridge 10 serving as a main tank for supplying ink to the sub tank 15 via the supply tube 16. The case body 101 (e.g., a container body) forms the ink container 100 (depicted in FIG. 5). The ink container 100 contains ink and includes an opening provided on one surface of the sub tank 15. The film member 102 (e.g., a flexible film-like member) has flexibility and is attached or welded to the case body 101 so as to seal the opening of the ink container 100.

As illustrated in FIG. 5, the spring 103 is an elastic member, provided at a position between the case body 101 and the film member 102 inside the ink container 100, and presses the film member 102 outward. The case body 101, the ink container 100, the film member 102, and the spring 103 form a negative pressure generator for generating negative pressure by supplying and discharging ink to and from the ink container 100.

The bulge 102A is provided for the spring 103. The reinforcement member 104 is attached to an outer surface of the bulge 102A. Since the bulge 102A becomes concave as a greater amount of ink is consumed, a volume of the ink container 100 may change. A sheet-like film member may be formed into a convex shape to easily form a convex portion of the film member 102.

The support members 107 are provided on a side of the case body 101. On an outer surface of the film member 102, there is provided the negative pressure lever 106 swingably attached to the support members 107. The negative pressure lever 106 may be displaced based on deformation of the film member 102. The spring 108 is provided between the case body 101 and the negative pressure lever 106, and presses the negative pressure lever 106 toward the film member 102. Accordingly, since the negative pressure lever 106 is displaced based on the deformation of the film member 102, that is, a change of volume of the sub tank 15, the volume of ink in the sub tank 15 may be detected by the negative pressure lever position sensor 303 (depicted in FIG. 2) detecting a position of the detection edge 106A of the negative pressure lever 106.

The ink introduction channel 111 is provided on top of the case body 101. Ink is supplied through the ink introduction channel 111 to the ink container 100. The connector 112 may be attachable to and detachable from the case body 101, and connects the ink introduction channel 111 and the supply tube 16 connected to the ink cartridge 10. A pump, described later, is provided between the ink cartridge 10 and the sub tank 15, and feeds ink from the ink cartridge 10 to the sub tank 15 with pressure. The connection member 113 is attached below the case body 101, and supplies ink from the ink container 100 to the recording head 14 through the ink supply channel 114 (depicted in FIG. 6). The filter 115 is provided between the ink container 100 and the connection member 113.

The air flow channel 121 is provided in an upper portion of the case body 101. Air flows out from the ink container 100 through the air flow channel 121. As illustrated in FIG. 6, the inlet channel portion 122 forms an opening of the case body 101, and is connected to the channel portion 123 (e.g., perpendicular channel portion). The channel portion 123 is connected to the air intake port 131, and also to the accumulation portion 126.

The accumulation portion 126 is provided in a portion lower than the air intake port 131 when the ink-jet recording apparatus 300 (depicted in FIG. 1) is in use. When the body 1 (depicted in FIG. 1) of the ink-jet recording apparatus 300 is inclined, or swung, ink may invade the air flow channel 121. Even if ink does invade the air flow channel 121, however, when the ink-jet recording apparatus 300 is dropped down during transportation the accumulation portion 126 captures the ink, thereby preventing a malfunction of the air intake valve mechanism 132 due to drying of the ink inside the air intake port 131 or the air intake valve mechanism 132 for opening and closing the air intake port 131.

The air intake valve mechanism 132 is provided in the air intake port 131. The holder 133 holds the valve seat 134, the ball 135, and the spring 136. The air intake valve mechanism 132 switches from a closed state to an open state inside the sub tank 15. The ball 135 serves as a valve plug. The spring 136 presses the ball 135 toward the valve seat 134. For example, as illustrated in FIG. 4, the drive unit 162 includes the lever 161. The lever 161 activates the air intake pin 153 to move the air intake pin 153 backward and forward. When the air intake pin 153 is activated to move into the air intake port 131, the ball 135 presses against the spring 136 and air flows into the sub tank 15.

The detection electrodes 141 and 142 are provided on top of the case body 101, and detect whether an amount of air inside the sub tank 15 exceeds a predetermined amount. Since a state of conduction between the detection electrodes 141 and 142 changes between a state in which both of the detection electrodes 141 and 142 are immersed in the ink and a state in which at least one of the detection electrodes 141 and 142 is not immersed in the ink, the amount of air may be detected.

Figure 8A:
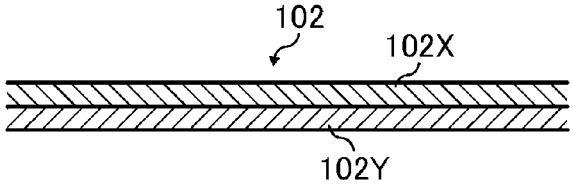
FIG. 8A is a sectional view of one example of a film member included in the sub tank shown in FIG. 7.
Figure 8B:
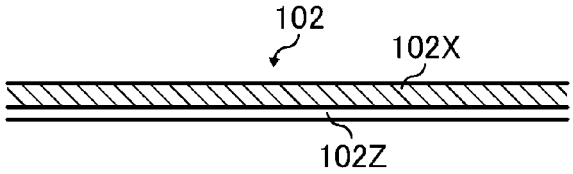
FIG. 8B is a sectional view of another example of a film member included in the sub tank shown in FIG. 7.
Figure 8C:
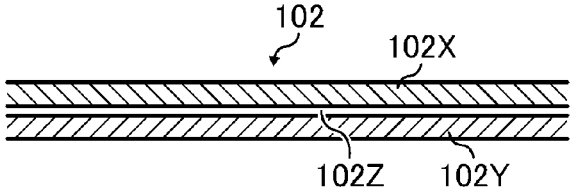
FIG. 8C is a sectional view of yet another example of a film member included in the sub tank shown in FIG. 7.

Referring to FIGS. 8A to 8C, a description is now given of examples of structure of the film member 102. FIGS. 8A to 8C illustrate a sectional view of the film member 102.

As illustrated in FIG. 8A, one example of the film member 102 includes a first layer 102× and a second layer 102Y. The film member 102 has a double-layered structure in which two different types of layers are laminated. For example, the first layer 102X includes polyethylene and the second layer 102Y includes nylon.

As illustrated in FIG. 8B, another example of the film member 102 includes the first layer 102X and a silica-evaporated layer 102Z. The silica-evaporated layer 102Z is formed on the first layer 102X.

As illustrated in FIG. 8C, yet another example of the film member 102 includes the first layer 102X, the second layer 102Y, and the silica-evaporated layer 102Z. The silica-evaporated layer 102Z is sandwiched between the first layer 102× and the second layer 102Y. Although the film member 102 may have a single layer structure, preferably, the film member 102 has any one of the structures illustrated in FIGS. 8A to 8C.

Since the film member 102 has a structure including two or more layers of different types, the film member 102 has increased resistance to ink contained in the ink container 100 (depicted in FIG. 7) and increased mechanical strength. For example, when the film member 102 includes the structure in which polyethylene and nylon layers are laminated as illustrated in FIG. 8A, the polyethylene layer (i.e., the first layer 102X) contacts ink. Although polyethylene has great resistance to ink and great moisture permeability, polyethylene has little air permeability, little mechanical strength, and little stretchability. Thus, lamination of the nylon layer (i.e., the second layer 102Y) may reinforce the polyethylene layer. Also, inclusion of the silica-evaporated layer 102Z may improve moisture permeability and air permeability of the film member 102.

The film member 102 may preferably have a thickness of from about 10 μm to about 100 μm. When the thickness is less than 10 μm, the film member 102 may be damaged due to deterioration with time. When the thickness exceeds 100 μm, flexibility of the film-like member 102 degrades, thereby causing difficulty in efficient generation of negative pressure.

Figure 9:
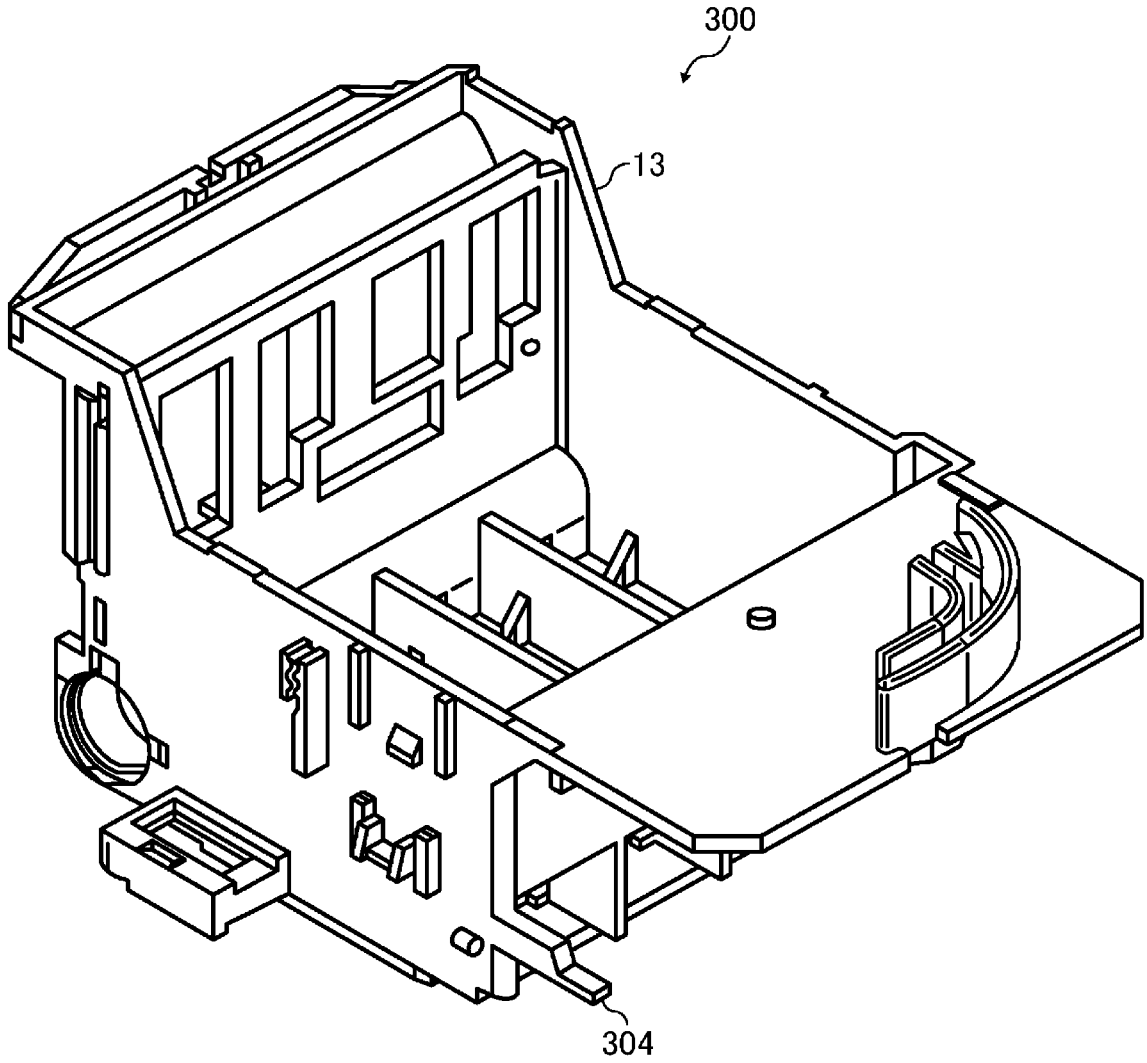
FIG. 9 is a perspective view of one example of a carriage included in the ink-jet recording apparatus shown in FIG. 2.

Referring to FIGS. 5, 6, and 9, a description is now given of example embodiments of the ink-jet recording apparatus 300.

FIG. 9 is a perspective view of the carriage 13 of the ink-jet recording apparatus 300. As illustrated in FIGS. 5 and 6, the detection edge 304, serving as a sub tank position indicator, is provided on the case body 101 of the sub tank 15. Thus, the negative pressure lever position sensor 303 (depicted in FIG. 2) may detect the detection edge 304, so that a position of the sub tank 15 may be precisely detected. The detection edge 304 may be provided in all or at least one of the case bodies 101 of the sub tanks 15 included in the ink-jet recording apparatus 300.

As illustrated in FIG. 9, the detection edge 304, serving as a sub tank position indicator, may be provided in the carriage 13 for carrying the recording head 14 (depicted in FIG. 4). Since an arrangement of the recording head 14 on the carriage 13 determines recording quality, a position of the carriage 13 with respect to the recording head 14 is precisely adjusted. Therefore, instead of indicating a position of the sub tank 15 (depicted in FIG. 4) connected to the recording head 14, indication of a position of the carriage 13 may provide a substantially equivalent effect. In order to simplify a structure of the ink-jet recording apparatus 300, in many cases, the negative pressure lever position sensor 303 (depicted in FIG. 2) may detect presence or absence of a negative pressure state position indicator (e.g., the negative pressure lever 106 depicted in FIG. 4) by combining with position detection of the carriage 13. However, when the negative pressure lever position sensor 303 does distinguish the detection edge 106A, serving as a negative pressure state indicator, from the detection edge 304, serving as a sub tank position indicator, a plurality of sensors detects the detection edges 106A and 304, respectively, and an algorithm identifies the sensor in order to prevent erroneous detection.

In order to distinguish the sub tank position indicator from the negative pressure state indicator, the detection edges 304 and 106A in a main scanning direction may be of different widths. Thus, detection as to how long each of the detection edges 304 and 106A blocks a sensing area may determine which detection edge has been detected. Similarly, the detection edges 304 and 106A may use materials, colors, and the like, different from each other so that the negative pressure lever position sensor 303 may output different output values corresponding to the different materials and colors. Thus, the detection edge detected by the negative pressure lever position sensor 303 may be identified based on the output value.

Although as a position detector of the detection edges 106A and 304 a combination of the negative pressure lever position sensor 303 and the carriage encoder sensor for detecting presence or absence of the detection edges 106A and 304 is described above, a laser displacement gage, and the like, for directly measuring an amount of displacement of the detection edges 106A and 304 by radiation to the detection edges 106A and 304 and reflection from the detection edges 106A and 304 may be used.

When a position of the detection edge 304, serving as a sub tank position indicator, is detected, if the position is different from an original position, a position of the sub tank 15 or the carriage 13 may be displaced due to a paper jam or the like. Therefore, after the displacement is detected, by displaying an error message to provide an instruction to remove a foreign object such as a jammed sheet, a normal state may return. If there is no such instruction, a shift error in a position of an image on a sheet and excessive ink supply operation due to error detection of a position of the negative pressure lever 106 may occur. The sub tank 15 supplied with excessive ink has an inappropriate negative pressure state, thereby causing leakage of ink from a nozzle surface.

As well as the above error display for a jammed paper removal instruction, excessive ink supply may be prevented by correction of position information of the negative pressure state indicator (e.g., the detection edge 16A) based on a result of the position detection by the detection edge 304, serving as a sub tank position indicator. Thereafter, an error message for a jammed paper removal instruction may be displayed, or necessity of the error message may be determined based on a shift amount. Therefore, the leakage of ink due to excessive ink supply may be prevented, as may the occurrence of paper jams. The above performance of error display depends on difference in sensitivity of the ink-jet recording apparatus 300 to an amount of change in position of the carriage 13. A shift amount of from about 1 mm to about 2 mm does not significantly affect image recording, however, when the negative pressure state indicator (e.g., the detection edge 106A) is installed in the ink-jet recording apparatus 300 having a compact size, the shift amount of from about 1 mm to about 2 mm has a large effect on image recording.

Figure 10:
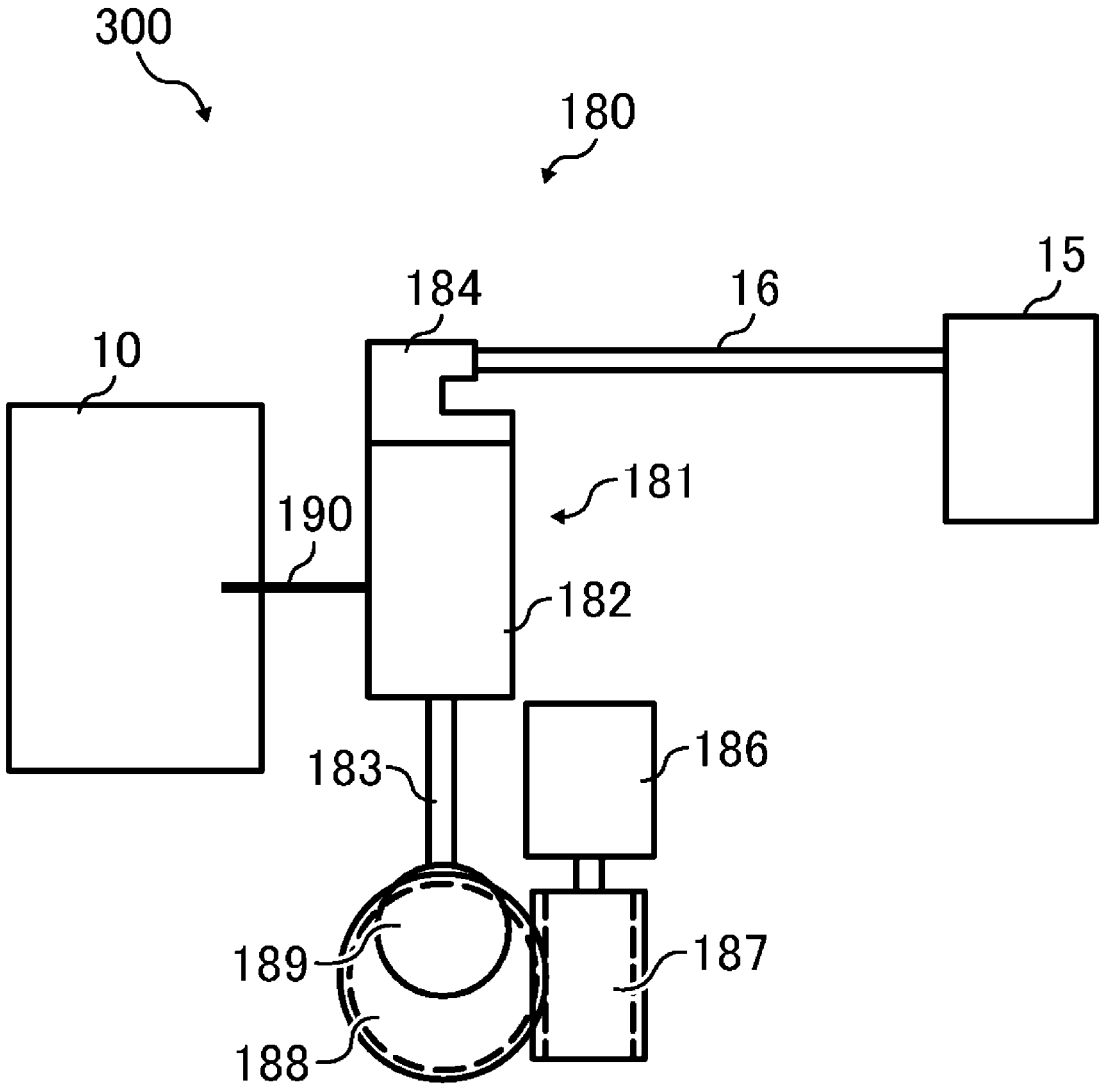
FIG. 10 is a schematic view of a liquid sending mechanism included in the ink-jet recording apparatus shown in FIG. 4.

Referring to FIG. 10, a description is now given of the liquid sending mechanism 180. The liquid sending mechanism 180 includes a piston pump 181, a drive motor 186, a worm gear 187, a worm wheel 188, a cam 189, and a hollow needle 190. The piston pump 181 includes a cylinder 182 and a piston 183. The cylinder 182 includes a connector 184.

One end of the hollow needle 190 is inserted into an ink outlet, not shown, of the ink cartridge 10, serving as a main tank, while another end of the hollow needle 190 is connected to the cylinder 182. The connector 184 connects the cylinder 182 to the supply tube 16. The cam 189 is provided integrally with the worm wheel 188. When the worm wheel 188 is driven to rotate due to rotation of the drive motor 186 via the worm gear 187, the cam 189 drives (e.g., reciprocates) the piston 183 of the piston pump 181. In the ink sending mechanism 180, ink in the ink cartridge 10 passes through the hollow needle 190 into the cylinder 182 due to negative pressure generated by movement of the piston pump 181. After the ink enters the cylinder 182, the reciprocating motion of the piston 183 sends the ink from the connector 184 to the sub tank 15 via the supply tube 16.

Figure 11:
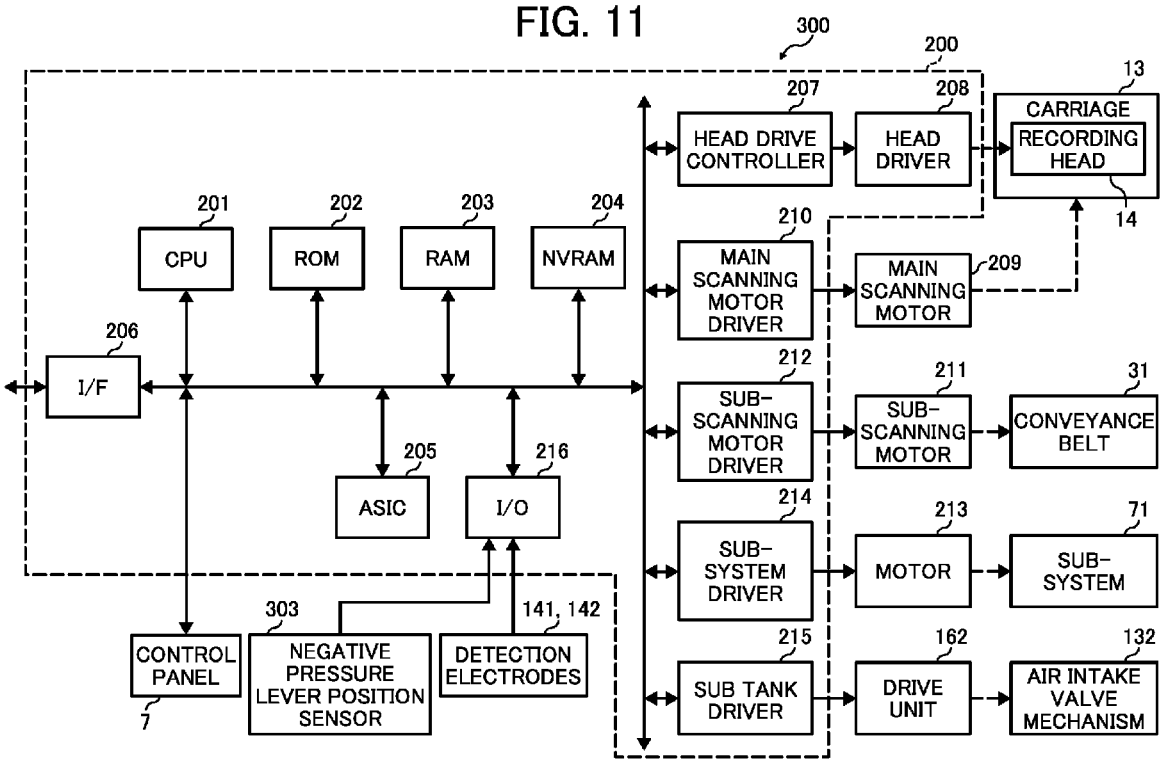
FIG. 11 is a block diagram of a controller included in the ink-jet recording apparatus shown in FIG. 2.

Referring to FIG. 11, a description is now given of the controller 200.

As an initial matter, it is to be noted that the ink-jet recording apparatus 300 further includes a main scanning motor 209, a sub-scanning motor 211, and a motor 213. The controller 200 includes a CPU 201, a ROM 202, a RAM 203, a NVRAM (nonvolatile random access memory) 204, an ASIC (application specific integrated circuit) 205, an I/F (interface) 206, a head drive controller 207, a head driver 208, a main scanning motor driver 210, a sub-scanning motor driver 212, a sub-system driver 214, a sub tank driver 215, and an I/O (input/output) 216.

The CPU 201 exercises overall control of the ink-jet recording apparatus 300. The ROM 202 stores a program executed by the CPU 201, and other fixed data. The RAM 203 temporarily stores image data, and the like. The NVRAM 204 retains data while the ink-jet recording apparatus 300 is powered off. The ASIC 205 performs various types of signal processing with respect to image data, image processing of performing sorting, and the like, and processing of input and output signals for controlling the whole ink-jet recording apparatus 300. The I/F 206 transmits and receives data and signals to and from a host, not shown. The head drive controller 207 and the head driver 208 drive and control the recording heads 14. The main scanning motor driver 210 drives the main scanning motor 209. The sub-scanning motor driver 212 drives the sub-scanning motor 211 to drive and control the conveyance belt 31. The motor 213 activates the suction pump for performing suction from the capping member 72A of the sub-system 71. The sub-system driver 214 drives the motor 213. The sub tank driver 215 drives the drive unit 162 for driving and controlling the air intake valve mechanism 132 for performing air intake into the sub tank 15. The I/O 216 inputs detection signals transmitted from the detection electrodes 141 and 142 of the sub tank 15, a detection signal transmitted from the negative pressure lever position sensor 303, and a detection signal transmitted from various sensors, not shown.

The negative pressure lever position sensor 303 detects an amount of ink stored in the sub tank 15 at a time of ink supply to the sub tank 15 by detecting that the detection edge 106A of the negative pressure lever 106 of the sub tank 15 is at a predetermined position. The controller 200 is connected to the control panel 7. The control panel 7 displays information necessary for a user to operate the ink-jet recording apparatus 300, and the user inputs a command by using the control panel 7. In the controller 200, the I/F 206 receives print data and the like from the host such as an information processing apparatus including a personal computer, an image reading apparatus including an image scanner, an imaging device such as a digital camera, and the like, via a cable or the Internet. After the CPU 201 reads and analyzes the print data in a receive buffer included in the I/F 206, the ASIC 205 performs necessary image processing, data sorting processing, and the like, and transfers image data to the head drive controller 207. Generation of dot pattern data for image output may be performed by storing font data in the ROM 202. Alternatively, a printer driver installed in the host may convert the image data into bit-mapped data and may transfer the bit-mapped data to the ink-jet recording apparatus 300. When the head drive controller 207 receives image data (e.g., dot pattern data) corresponding to one line of an image recorded by the recording head 14, the head drive controller 207 sends the dot pattern data of one line to the head driver 208 as serial data in synchronism with a clock signal and sends a latch signal to the head driver 208 at a proper time. The head drive controller 207 includes a ROM (e.g., the ROM 202) storing pattern data of a drive waveform (e.g., a drive signal), a waveform generation circuit including a digital-to-analog converter for converting drive waveform data read by the ROM from digital data to analog data, and a drive waveform generation circuit including an amplifier. The head driver 208 includes a shift register for inputting the clock signal transmitted from the head drive controller 207 and the serial data being image data, a latch circuit for latching a register value of the shift register with a latch signal transmitted from the head drive controller 207, a level conversion circuit (e.g., a level shifter) for changing a level of an output value of the latch circuit, and an analog switch array (e.g., a switch) turned on and off by the level shifter. By controlling turning on and off of the analog switch array, the head driver 208 selectively applies a desired drive waveform included in the drive waveforms to an actuator of the recording head 14 to drive the recording head 14.

The CPU 201 measures consumed fluid volume by counting the number of liquid drops discharged from the recording heads 14. When the CPU 201 stores an amount of liquid drops to be discharged according to discharging patterns, the CPU 201 measures an amount of consumed fluid (e.g., an amount of ink used) by counting the number of discharges (e.g., the number of liquid drops) in each discharging pattern. Specifically, when the CPU 201 retains in advance information about amounts of liquid drops to be discharged and to be suctioned, an amount of ink used V (e.g., ink consumption V) may be detected by calculation using the following formula (1).

$$V=\Sigma(D\times Nd)+\Sigma(S\times Ns) \quad (1)$$

In the above formula (1), V represents an amount of ink used. D represents an amount of liquid drops discharged. Nd represents the number of discharges. S represents an amount of liquid drops suctioned. Ns represents the number of suctions.

Since the sub tank 15 has a plastic structure including a flexible film-like member (e.g., the film member 102) and an elastic member (e.g., the spring 103), provision of a detector for precisely detecting liquid amount to the sub tank 15 is difficult. Thus, the amount of consumed ink may be simply and precisely obtained by adding the amount of discharged liquid drops multiplied by the number of discharges to the amount of suctioned liquid drops multiplied by the number of suctions. When there is a plurality of levels of the amount of liquid drops discharged and the amount of liquid drops suctioned, a total sum of a product of an individual amount and number may be obtained. Actually, since the amounts of liquid drops discharged vary among the recording heads 14, preferably a calculation value of the amount of liquid drops discharged is corrected based on a coefficient set in advance according to a parameter reflecting a liquid discharging property of the recording heads 14. That is, a head for discharging a great size of a liquid drop may be made to discharge a small number of drops, whereas a head for discharging a small size of a liquid drop may be made to discharge a great number of drops. Therefore, the variations in the amounts of liquid drops discharged among different ink-jet recording devices and among different recording heads may be decreased, thereby obtaining an uniform output image. When the CPU 201 retains in advance information about amounts of liquid drops discharged and suctioned according to discharging patterns, the amount of ink used may be detected by calculation using the following formula (2);

$$V=\Sigma(Dp\times Ndp)+\Sigma(Sp\times Nsp) \quad (2)$$

In the above formula (2), V represents an amount of ink used. Dp represents an amount of liquid drops discharged in each pattern. Ndp represents the number of discharges in each pattern. Sp represents an amount of liquid drops suctioned in each pattern. Nsp represents the number of suctions in each pattern.

For example, in gradation printing, since the CPU 201 retains in advance data of an amount of liquid discharged according to gradation patterns, the CPU 201 may detect (e.g., calculate) a liquid amount with greater precision by multiplication of the data of the amount of liquid discharged and the frequency of occurrence of gradation than by multiplication of the amount of liquid drops discharged and the number of discharges. The difference between formulas (1) and (2) is that, in formula (1), the values may vary depending on the frequency characteristic of the amount of discharges and the like, whereas in formula (2) the variations are considered as data in advance, so that the liquid amount may be more precisely detected.

Figure 12:
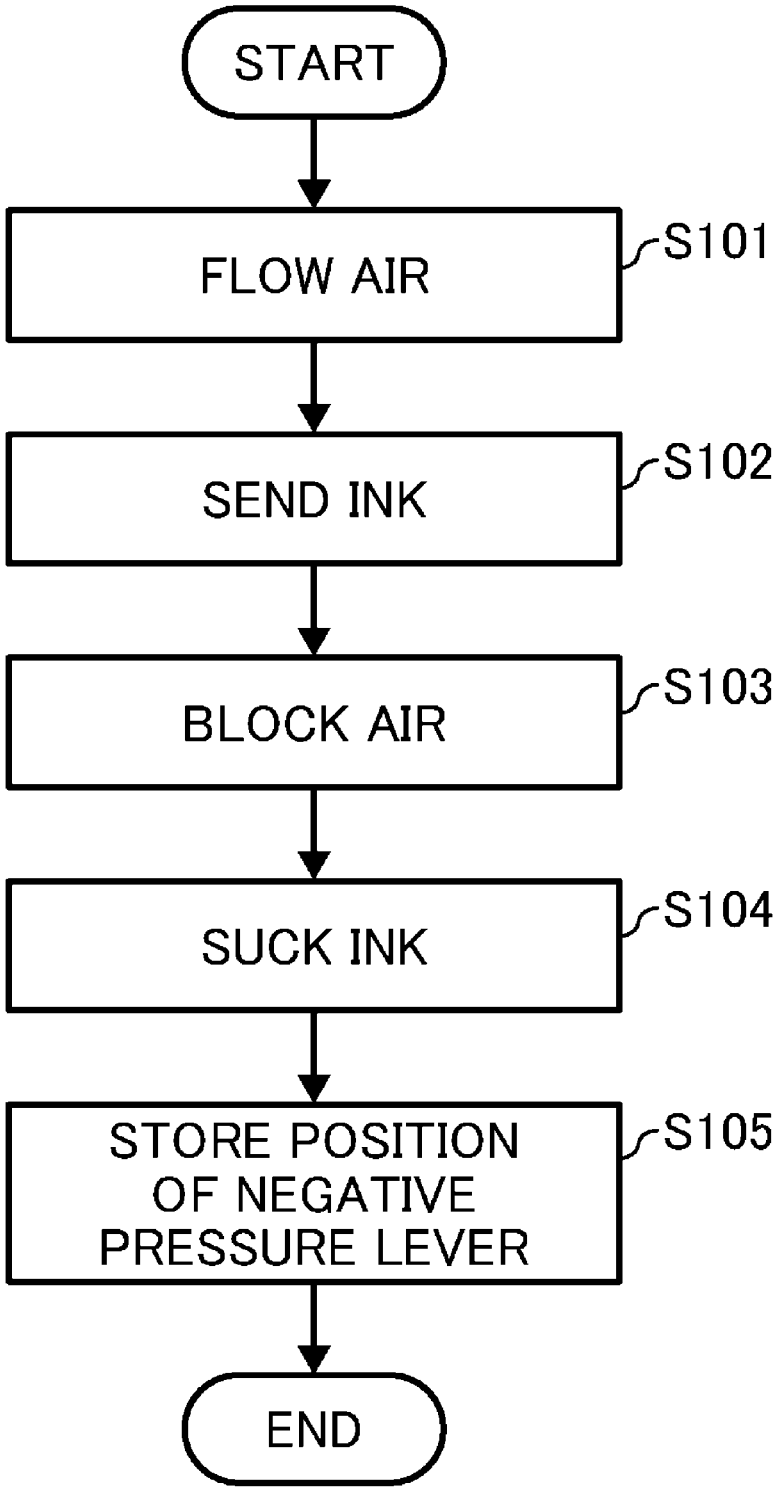
FIG. 12 is a flowchart illustrating an air intake operation in the ink supply device shown in FIG. 4.

Referring to FIG. 12, a description is now given of an ink supply operation for supplying ink from the ink cartridge 10 (depicted in FIG. 4) to the sub tank 15 (depicted in FIG. 4).

In the ink supply device 301 (depicted in FIG. 4), the ink supply operation includes air intake operation and normal supply operation. In the air intake operation, ink is supplied to the sub tank 15 by air intake, while in the normal supply operation, ink is supplied to the sub tank 15 without air intake.

FIG. 12 is a flowchart of the air intake operation. In step S101, when the drive unit 162 (depicted in FIG. 4) activates the air intake pin 153 (depicted in FIG. 4) to open the air intake valve mechanism 132 (depicted in FIG. 4), air flows into the sub tank 15. Thus, the film member 102 (depicted in FIG. 5) is pressed outward due to restoring force of the spring 103 (depicted in FIG. 5), and a volume of the sub tank 15 increases (e.g., a negative pressure generation portion expands). In step S102, the liquid sending mechanism 180 (depicted in FIG. 10) sends ink from the ink cartridge 10 to the sub tank 15 to replenish the sub tank 15 with the ink. In step S103, the drive unit 162 closes the air intake valve mechanism 132 to block air entering the sub tank 15. In step S104, when the capping member 72A of the sub-system 71 (depicted in FIG. 3) caps the nozzle surface of the corresponding recording head 14 (depicted in FIG. 3), and the head driver 208 (depicted in FIG. 11) is driven to activate the suction pump (not shown), the suction pump suctions a predetermined amount of ink in the sub tank 15 from the nozzle surface of the recording head 14. Accordingly, the film member 102 of the sub tank 15 is deformed inward against a pressing force of the spring 103 so that the volume of the sub tank 15 decreases (e.g., the negative pressure generation portion contracts), thereby generating initial negative pressure. In step S105, the negative pressure lever position sensor 303 (depicted in FIG. 2) detects and stores a position of the detection edge 106A of the negative pressure lever 106 (depicted in FIG. 4).

A description is now given of another air intake operation. For example, when air flows into the sub tank 15, after the negative pressure lever 106 presses the film member 102 inward against the spring 103 to decrease the volume of the sub tank 15, the liquid sending mechanism 180 sends ink from the ink cartridge 10 to the sub tank 15 to replenish the sub tank 15 with the ink. When the drive unit 162 closes the air intake valve mechanism 132 to block air entering the sub tank 15, release of pressing force by the negative pressure lever 106 causes the pressing force of the spring 103 to push the film member 102 outward, thereby generating negative pressure inside the sub tank 15. Since the film member 102 and the spring 103 may generate negative pressure in the sub tank 15, a simple negative pressure generation mechanism may be provided.

A description is now given of the normal supply operation. When a desired amount of ink consumption V is detected by counting the number of liquid drops discharged, the liquid sending mechanism 180 sends ink from the ink cartridge 10 to the sub tank 15 without opening the sub tank 15, so as to replenish the sub tank 15 with the desired amount of ink. A drive time of the piston pump 181 (depicted in FIG. 10) is controlled so as to adjust the amount of ink sent to the sub tank 15. Preferably, the amount of ink sent to the sub tank 15 is equal to the ink consumption V. However, an error in calculation of the ink consumption V may occur due to variations in the size of a liquid drop discharged or the amount of ink suctioned. Moreover, the amount of ink supplied to the sub tank 15 may vary depending on timing due to reciprocating movement of the piston pump 181. As ink consumption and normal supply operation are repeated, the amount of ink inside the sub tank 15 may gradually deviate from the ink consumption V due to the error in calculation of the ink consumption V and the variation in the amount of ink supplied. As a result, negative pressure in the sub tank 15 also may vary. Thus, as described above, after the air intake operation, when the suction pump suctions a predetermined amount of ink, and the initial negative pressure is generated, the negative pressure lever position sensor 303 stores the position of the negative pressure lever 106. Since the film member 102 becomes concaved as the ink in the sub tank 15 is consumed, the negative pressure lever 106 also moves (e.g., displaces) toward the sub tank 15. In the normal supply operation, when the negative pressure lever position sensor 303 reads that the negative pressure lever 106 moves back to the stored original position the supply operation is stopped. Accordingly, errors due to the above-described variations decline so as to maintain the initial negative pressure immediately after the normal supply operation.

The operation of supplying ink to the sub tank 15 by performing air intake (e.g., air intake operation) does not need to be performed every time the ink in the sub tank 15 is consumed, but may be performed when a predetermined amount of ink in the sub tank 15 is consumed. Otherwise, the normal supply operation may supply ink to the sub tank 15 without performing air intake.

Figure 13:
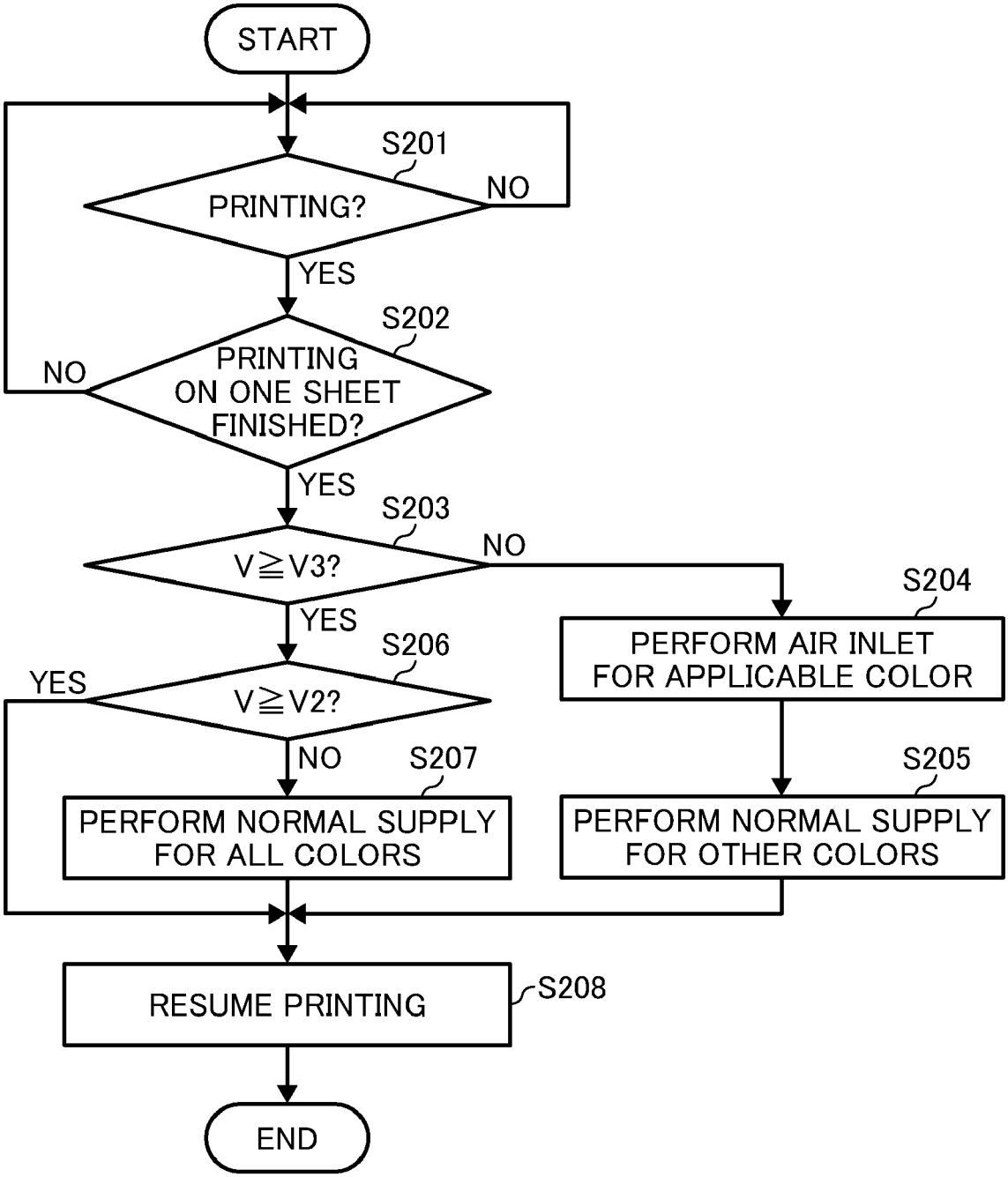
FIG. 13 is a flowchart illustrating one example of an ink supply operation in the ink supply device shown in FIG. 4.
Figure 14:
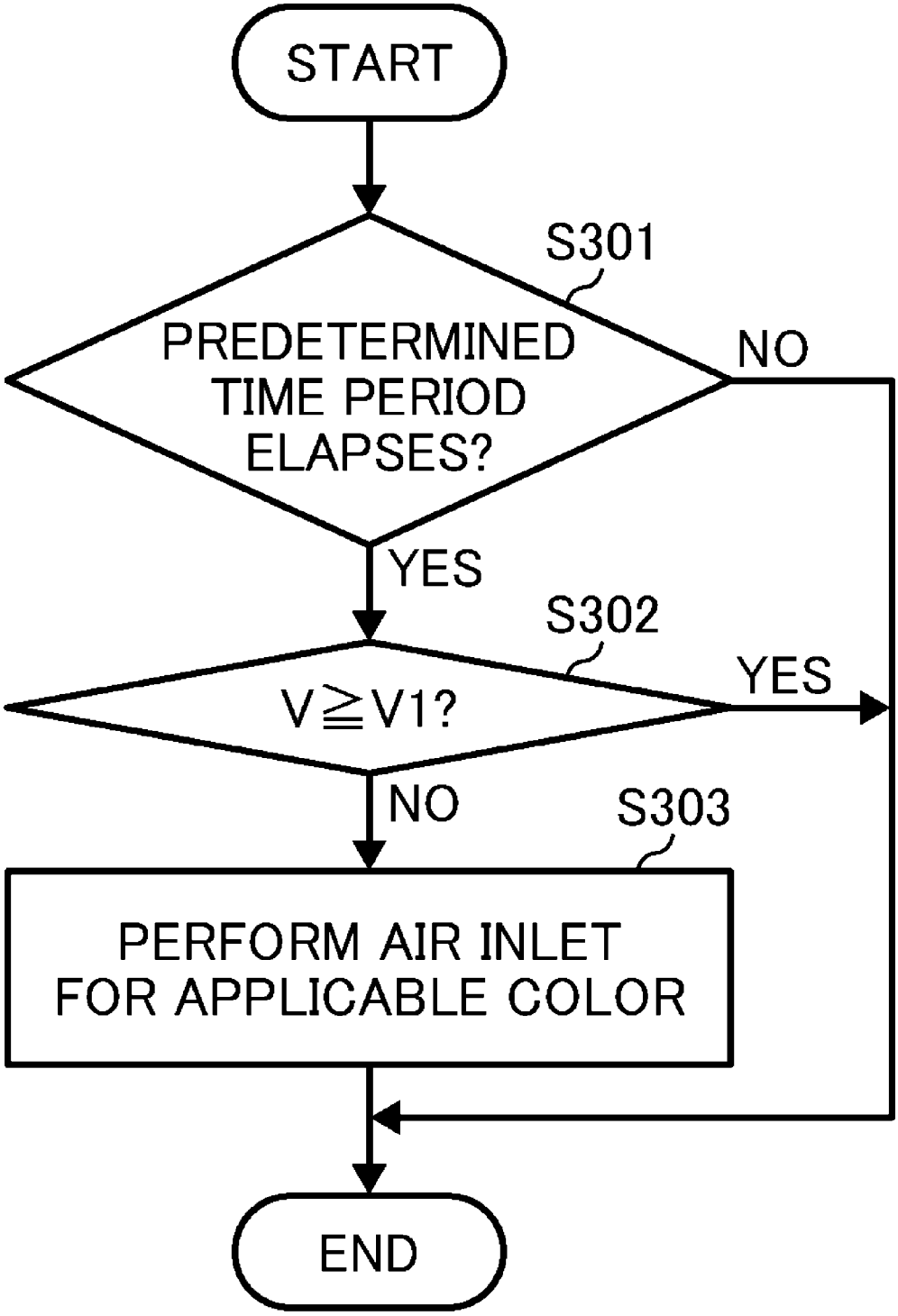
FIG. 14 is a flowchart illustrating another example of an ink supply operation in the ink supply device shown in FIG. 4.

Referring to FIGS. 13 and 14, a detailed description is now given of control of the ink supply operation in the ink-jet recording apparatus 300.

FIGS. 13 and 14 illustrate a flowchart showing the ink supply operation.

As illustrated in FIG. 13, in step S201, the CPU 201 (depicted in FIG. 11) determines whether or not printing is performed. If printing is performed (e.g., if YES is selected in step S201), the CPU 201 determines whether or not printing on one sheet is finished in step S202. When printing on one sheet is finished (e.g., if YES is selected in step S202), the CPU 201 reads measured ink consumption V in each color and compares the ink consumption V with a predetermined third reference value V3 to determine whether or not the ink consumption V is not smaller than the third reference value V3 in step S203. In this flowchart, "printing on one sheet" denotes printing on one page, or printing on one side of one sheet in duplex printing. When the ink consumption V of at least one color of ink is not smaller than the third reference value V3 (e.g., if NO is selected in step S203), the applicable color ink (e.g., ink for which the ink consumption V is not smaller than the third reference value V3) is supplied from the ink cartridge 10, serving as a main tank, to the sub tank 15 by performing the air intake operation in step S204. In step S205, ink is supplied to the sub tanks 15 of the other colors of ink (e.g., ink for which the ink consumption V is smaller than the third value V3) by the normal supply operation. In step S208, printing resumes.

When the ink consumption V is smaller than the third reference value V3 for all colors of ink (e.g., if YES is selected in step S203), the CPU 201 compares the ink consumption V with a second reference value V2, which is smaller than the third reference value V3, and determines whether or not the ink consumption V is not smaller than the second reference value V2 in step S206. When the ink consumption V of any color is not smaller than the second reference value V2 (e.g., if NO is selected in step S206), ink is supplied to the sub tanks 15 of all colors of ink by the normal supply operation in step S207. In step S208, printing resumes.

As illustrated in FIG. 14, in step S301, the CPU 201 (depicted in FIG. 11) determines whether or not a predetermined time period elapses after printing is finished. When the predetermined time period elapses (e.g., if YES is selected in step S301), the CPU 201 reads ink consumption V of each color and compares the ink consumption V with a predetermined first reference value V1 to determine whether or not the ink consumption V is not smaller than the first reference value V1 in step S302. When the ink consumption V of at least one color of ink is not smaller than the first reference value V1

(e.g., if NO is selected in step S302), the applicable color ink (e.g., ink for which the ink consumption V is not smaller than the first reference value V1) is supplied from the ink cartridge 10, serving as a main tank, to the sub tank 15 by performing the normal supply operation when the capping member 72A (depicted in FIG. 3) caps the nozzle surface of the recording head 14 (depicted in FIG. 3) for nozzle recovery operation) in step S303. For example, a counter, not shown, counts the ink consumption V measured in ml. The first reference value V1 is set to 0.2, the second reference value V2 is set to 0.9, and the third reference value V3 is set to 1.1. When the ink consumption V is not smaller than 0.2 after a predetermined time period elapses after printing, the applicable color of ink is supplied by the normal supply operation while the capping member 72A caps the nozzle surface of the recording head 14. After printing on one sheet is finished, if the ink consumption V is smaller than 1.1 and not smaller than 0.9, all colors of ink is supplied by the normal supply operation, and printing resumes. If the ink consumption V is not smaller than 1.1, the applicable color of ink is supplied by the air intake operation, and the other colors of ink are supplied by the normal supply operation, and printing resumes.

Although the above-described exemplary embodiments are adapted to the ink-jet recording apparatus 300 (depicted in FIG. 1) serving as an image forming apparatus, the above-described exemplary embodiments may be adapted to a copying machine, a facsimile, a printer, or a multi-function printer having two or more of copying, printing, scanning, and facsimile functions. Similarly, the above-described exemplary embodiments may be adapted to an image forming apparatus using a recording liquid other than ink, and to a liquid supply device for supplying various liquids.

Referring to FIGS. 1, 2, 3, and 6, a description is now given of a first evaluation of a paper jam performed by using the ink-jet recording apparatus 300 shown in FIGS. 1 and 2 mounted with the sub tank 15 shown in FIG. 6. For example, when an A4 size sheet, which is folded into one eighth, is left on the sub-system 71 (depicted in FIG. 3) provided on the right side of the carriage 13 (depicted in FIG. 3) during image recording, and the carriage 13 returns to a position above the sub-system 71 when image recording is finished, the position of the carriage 13 shifts since the folded sheet impedes the carriage 13. The negative pressure lever position sensor 303 (depicted in FIG. 2) detects that the detection edge 304 (depicted in FIG. 3), serving as a sub tank position indicator, provided in the sub tank 15 is shifted from an original position. Thus, an error message for prompting removal of a jammed sheet is displayed.

Referring to FIGS. 1, 2, 3, and 9, a description is now given of a second evaluation of a paper jam performed by using the ink-jet recording apparatus 300 shown in FIGS. 1 and 2 mounted with the sub tank 15 shown in FIG. 6 on the carriage 13 shown in FIG. 9. The sub tank 15 does not have the detection edge 304 (depicted in FIG. 3), serving as a sub tank position indicator, and an evaluation similar to the first evaluation is performed. Ten out of ten times the negative pressure lever position sensor 303 (depicted in FIG. 2) detects that the detection edge 304 provided in the carriage 13 as illustrated in FIG. 9 is shifted from an original position. Thus, an error message for prompting removal of a jammed sheet is displayed.

A description is now given of a third evaluation performed under conditions similar to the conditions of the first evaluation. A solid image is formed on almost all areas of a sheet and five sheets having the solid image are output. Thus the third evaluation is performed under conditions in which ink consumption increases and ink supply operation starts before capping. When a suppliable amount of ink is set as position information of the negative pressure lever position sensor 303 based on position information of the detected detection edge 304 of the sub tank 15 while proper negative pressure is maintained, ink supply operation is normally finished without supplying excessive ink to the sub tank 15. An error message for prompting removal of a jammed sheet is not displayed since the position of the detection edge 304 is detected to be slightly shifted from an original position.

A description is now given of a fourth evaluation performed under a condition similar to the condition of the second evaluation. When the ink-jet recording apparatus 300 is powered off, an eighth folded sheet is sandwiched between the carriage 13 and a side plate. When powered on, the carriage 13 moves and the folded sheet is unfolded on the sub-system 71. The detection edge 304 provided in the carriage 13 is found to be substantially shifted from an original position, and thus an error message for prompting removal of a jammed sheet is displayed.

A description is now given of a fifth evaluation performed under a condition similar to the condition of the second evaluation. When a sheet, which is folded and wrinkled many times on purpose, is put into the paper tray 2 (depicted in FIG. 1), a printing evaluation is performed. One out of a few dozens of sheets is jammed due to the wrinkles, and further, five sheets are sandwiched between the carriage 13 and the conveyance belt 31, and the torn sheet at the time of jam is sandwiched outside a home position of the carriage 13 (e.g., a position where all recording heads 14 are capped in a standby mode, and the like). After the a jammed sheet sandwiched between the carriage 13 and the conveyance belt 31 is removed, the negative pressure lever position sensor 303 reads the detection edge 304 provided in the carriage 14 to detect that the carriage 13 is shifted. Thus, an error message for prompting removal of a jammed sheet is displayed.

A description is now given of a first comparison in which an evaluation equal to the first evaluation is performed under a condition similar to the condition of the first evaluation, except that the detection edge 304, serving as a sub tank position indicator, is not provided in the sub tank 15. Since the sub tank position indicator is not provided, overall width scanning is performed by the carriage 13 to detect a planned width. Although the carriage 13 performs the overall width scanning, three out of ten times an eighth folded sheet with a thickness of about 1 mm is not detected due to lack of detection precision. Thereafter, excessive ink is supplied to the sub tank 15 in the normal supply operation, causing leakage of a great amount of ink on the conveyance belt 31.

A description is now given of a second comparison in which an evaluation equal to the second evaluation is performed under a condition similar to the condition of the second evaluation, except that the detection edge 304 is not provided in the carriage 13. Although the carriage 13 performs the overall width scanning, two out of ten times thickness of an eighth folded sheet, which is folded into eight parts, is not detected due to lack of detection precision. Then, excessive ink is supplied to the sub tank 15 in the normal supply operation, causing leakage of a great amount of ink on the conveyance belt 31.

A description is now given of a third comparison in which an evaluation equal to the fourth evaluation is performed under a condition similar to the condition of the fourth evaluation, except that the detection edge 304 is not provided in the carriage 13. When powered on, the carriage 13 moves to scan overall width, and thickness of an eighth folded sheet is not detected due to lack of detection precision. Then, excessive ink is supplied to the sub tank 15 in the normal supply operation, causing leakage of a great amount of ink on the conveyance belt 31.

A description is now given of a fourth comparison in which an evaluation equal to the evaluation in the fifth evaluation is performed under a condition similar to the condition of the fifth evaluation, except that the detection edge 304 is not provided in the carriage 13. After removal of a sheet sandwiched between the carriage 13 and the conveyance belt 31, the carriage 13 scans the overall width. Ink adhering to the nozzle surface of the recording head 14 during a paper jam falls onto the conveyance belt 31, staining the conveyance belt 31. Further, the sheet sandwiched between the carriage 13 and the side plate is not detected due to lack of detection precision. When printing is performed, the ink adhered to the conveyance belt 31 is transferred to a back surface of a recording sheet, thereby degrading image quality.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2006-334354 filed on Dec. 12, 2006 in the Japan Patent Office, the entire contents of which are hereby incorporated herein by reference.

What is claimed is:

1. An image forming apparatus, comprising:

a recording head configured to discharge recording liquid;

a main tank configured to supply the recording liquid;

a sub tank supplied with the recording liquid from the main tank and configured to supply the recording liquid to the recording head;

a negative pressure state indicator displaced according to a negative pressure state of the sub tank to indicate a negative pressure state of the sub tank;

a position detector configured to detect displacement of the negative pressure state indicator as position information; and a sub tank position indicator detected by the position detector and configured to indicate a position of the sub tank without being displaced according to the negative pressure state of the sub tank.

2. The image forming apparatus according to claim 1, further comprising:

a carriage configured to carry the recording head and the sub tank position indicator.

3. The image forming apparatus according to claim 1, wherein the sub tank position indicator and the negative pressure state indicator have at least one of a material, a shape, and a color different from each other.

4. A method for controlling an image forming apparatus, comprising:

detecting a position of a sub tank position indicator with a position detector;

detecting a position of a negative pressure state indicator;

correcting position information of the negative pressure state indicator based on information about the detected position of the sub tank position indicator;

detecting a negative pressure state of a sub tank based on the corrected position information of the negative pressure state indicator; and in response to a detected negative pressure state of the sub tank, supplying recording liquid from a main tank to the sub tank while the position detector detects the negative pressure state indicator.

5. The method for controlling the image forming apparatus according to claim 4, further comprising:

detecting a shift in position of a carriage based on information about the position of the sub tank position indicator detected by the position detector when the image forming apparatus is powered on.

6. The method for controlling the image forming apparatus according to claim 4, further comprising:

detecting a shift in position of a carriage based on information about the position of the sub tank position indicator detected by the position detector after removal of a jammed recording medium.

7. The method for controlling the image forming apparatus according to claim 4, further comprising:

issuing warning information indicating a malfunction of the image forming apparatus when a position of the sub tank detected by the position detector is different from a preset, predetermined position.

8. A method for controlling an image forming apparatus, comprising:

detecting a position of a sub tank position indicator with a position detector;

detecting a position of a negative pressure state indicator;

correcting position information of the negative pressure state indicator based on information about the detected position of the sub tank position indicator;

detecting a negative pressure state of a sub tank based on the corrected position information of the negative pressure state indicator; and in response to a detected negative pressure state of the sub tank, supplying recording liquid from a main tank to the sub tank until the position detector detects the negative pressure state indicator.

9. The method for controlling the image forming apparatus according to claim 8, further comprising:

detecting a shift in position of a carriage based on information about the position of the sub tank position indicator detected by the position detector when the image forming apparatus is powered on.

10. The method for controlling the image forming apparatus according to claim 8, further comprising:

detecting a shift in position of a carriage based on information about the position of the sub tank position indicator detected by the position detector after removal of a jammed recording medium.

11. The method for controlling the image forming apparatus according to claim 8, further comprising:

issuing warning information indicating a malfunction of the image forming apparatus when a position of the sub tank detected by the position detector is different from a preset, predetermined position.

* * * * *